US006509551B2

(12) United States Patent
Metcalfe et al.

(10) Patent No.: US 6,509,551 B2
(45) Date of Patent: Jan. 21, 2003

(54) ADAPTIVE SYSTEM FOR CONTROLLING THE DURATION OF A SELF-CLEAN CYCLE IN AN OVEN

(75) Inventors: Lawrence D Metcalfe, St. Joseph, MI (US); Richard L. Baker, Lewisburg, OH (US); Erin M. May, Miamisburg, OH (US)

(73) Assignee: Whirlpool Corporation, Benton Harbor, MI (US)

( * ) Notice: Subject to any disclaimer, the term of this patent is extended or adjusted under 35 U.S.C. 154(b) by 0 days.

(21) Appl. No.: 09/900,931

(22) Filed: Jul. 9, 2001

(65) Prior Publication Data

US 2002/0096510 A1 Jul. 25, 2002

Related U.S. Application Data

(60) Provisional application No. 60/217,543, filed on Jul. 12, 2000.

(51) Int. Cl.[7] ..... H05B 1/02; F24C 14/02

(52) U.S. Cl. ..... 219/492; 219/497; 219/413; 219/506; 134/19; 126/273 R

(58) Field of Search ..... 219/411–414, 497, 219/492, 501, 494, 506; 134/1, 18, 19; 395/900; 126/273 R

(56) References Cited

U.S. PATENT DOCUMENTS

| | | | | |
|---|---|---|---|---|
| 4,954,694 A | | 9/1990 | Nagai et al. | 219/413 |
| 5,083,010 A | | 1/1992 | Henry et al. | 219/413 |
| 5,386,099 A | * | 1/1995 | Has | 219/413 |
| 6,392,204 B2 | * | 5/2002 | Corda et al. | 219/413 |

* cited by examiner

*Primary Examiner*—Mark Paschall
(74) *Attorney, Agent, or Firm*—Robert O. Rice; Stephen D. Krefman; Thomas J. Roth

(57) ABSTRACT

A method for controlling the duration of a self-cleaning operation in an oven responsive to the oven usage. The oven includes a cooking chamber, a heating device for supplying heat into the cooking chamber, an exhaust outlet from the cooking chamber leading to atmosphere, and a heat control device for controlling the heating device for baking, broiling and self-cleaning cycles. The method of controlling the duration includes the steps of maintaining a count at the heat control device of the length of oven operation time performed since a last self-cleaning cycle, accepting an input at the heat control device to begin a self-cleaning operation, and controlling the heating device to heat the oven cavity for a time period based upon the length of oven operation time performed since a last self-cleaning cycle.

15 Claims, 4 Drawing Sheets

ADAPTIVE SYSTEM FOR CONTROLLING THE DURATION OF A SELF-CLEAN CYCLE IN AN OVEN

BACKGROUND OF THE INVENTION

The present invention relates to self-cleaning ovens and in particular, to a system for controlling the operation of a self-cleaning oven.

During the use of an oven of an electric or gas range, deposits will generally accumulate as a result of spills, boil overs and other unintended release of foods from their cooking containers. In order to ease the cleaning of the spillage, provision is made in some ranges, known as "self-cleaning" ranges, to raise the temperature of the cooking cavity well above that which would be used in cooking in order to carbonize or bum out the residue. In general, this is achieved by the selection through the range's controls of a self-clean cycle. Initiation of this cycle typically sets a high control temperature for the range, locks the oven door at some predetermined time or temperature and proceeds to heat the cavity to a relatively high temperature for a predetermined time before ending the cycle, allowing cooling to occur and then releasing the door lock as an end to the cycle.

Typically, the time period set for this self-clean cycle is determined by the assumption of a worst case cycle. During the cycle, odors or even smoke may be released in the range environment and significant energy is used to hold the cooking cavity at a high temperature. Because of odor and smoke release, users are advised to open windows and will frequently leave the kitchen area for an extended period of time while self-clean is performed.

If a method can be devised which adjusts the time of self-cleaning to that needed for the existing degree of soil accumulation, then cycle times and their negative impact on kitchen environment and energy usage can be minimized.

U.S. Pat. No. 4,954,694 discloses a self-cleaning oven which incorporates a heat controlled unit which is responsive to a gas signal from a gas sensor located in the exhaust passage. The gas sensor measures humidity or carbon dioxide levels. The heat control samples the gas signal at a given time interval to detect a variation of amount of the gas component and detect a first inflection point from decreasing to increasing or visa versa in a gas-component variation and a second inflection point from decreasing to increasing or vice versa in the gas component variation after detection of the first inflection point. The heat control means determines the heating time period for cleaning in correspondence with the second inflection point. An oxidizing catalyst is provided in the exhaust passage, upstream of the gas sensor.

SUMMARY OF THE INVENTION

It is generally recognized that the combustion of food product will generate various gases or gas components. This invention is generally directed to controlling the operation of a self cleaning oven wherein the duration of a self clean cycle is responsive to the amount of soil accumulation in the oven.

According to the present invention, the duration of the self-clean cycle is determined by monitoring the usage of the oven and the frequency of the self cleaning cycle. The amount of clean time needed to perform the self-cleaning cycle is determined by monitoring the number or length of bake and broil cycles the user has performed since the last self-clean cycle is counted. The number of days since a self-clean cycle has been run is also counted. A minimum clean base time based on these factors is then be determined. Thus, when the user selects and starts a clean cycle, the number or length of bake and broil cycles and the number of days the oven has not been cleaned, are retrieved and used to determine the appropriate clean time. The calculated clean time is displayed to the user to show the length of the clean cycle.

DETAILED DESCRIPTION OF THE PREFERRED EMBODIMENTS

Figure 1:
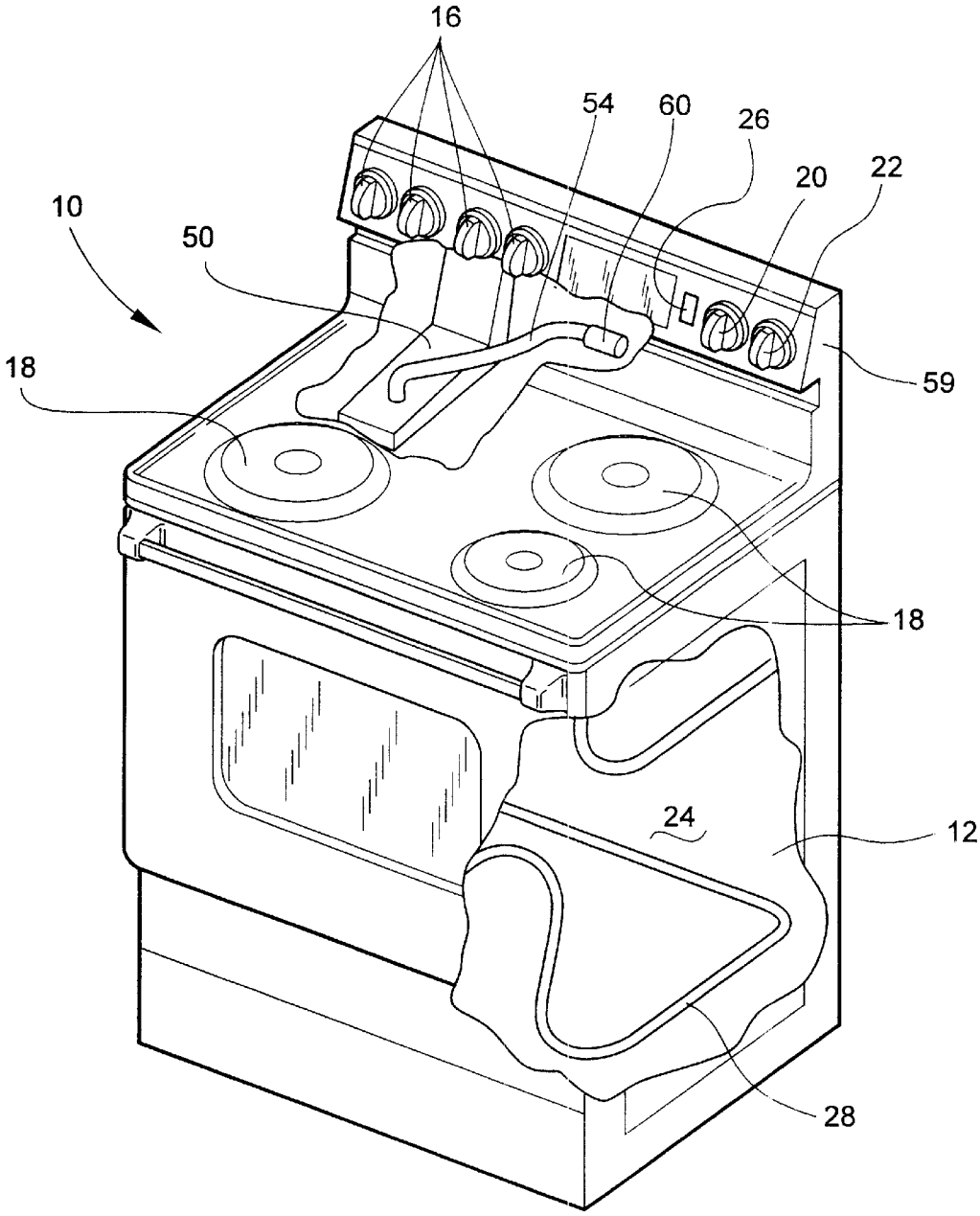
FIG. 1 is a perspective view of an oven embodying the principles of the present invention.
Figure 2:
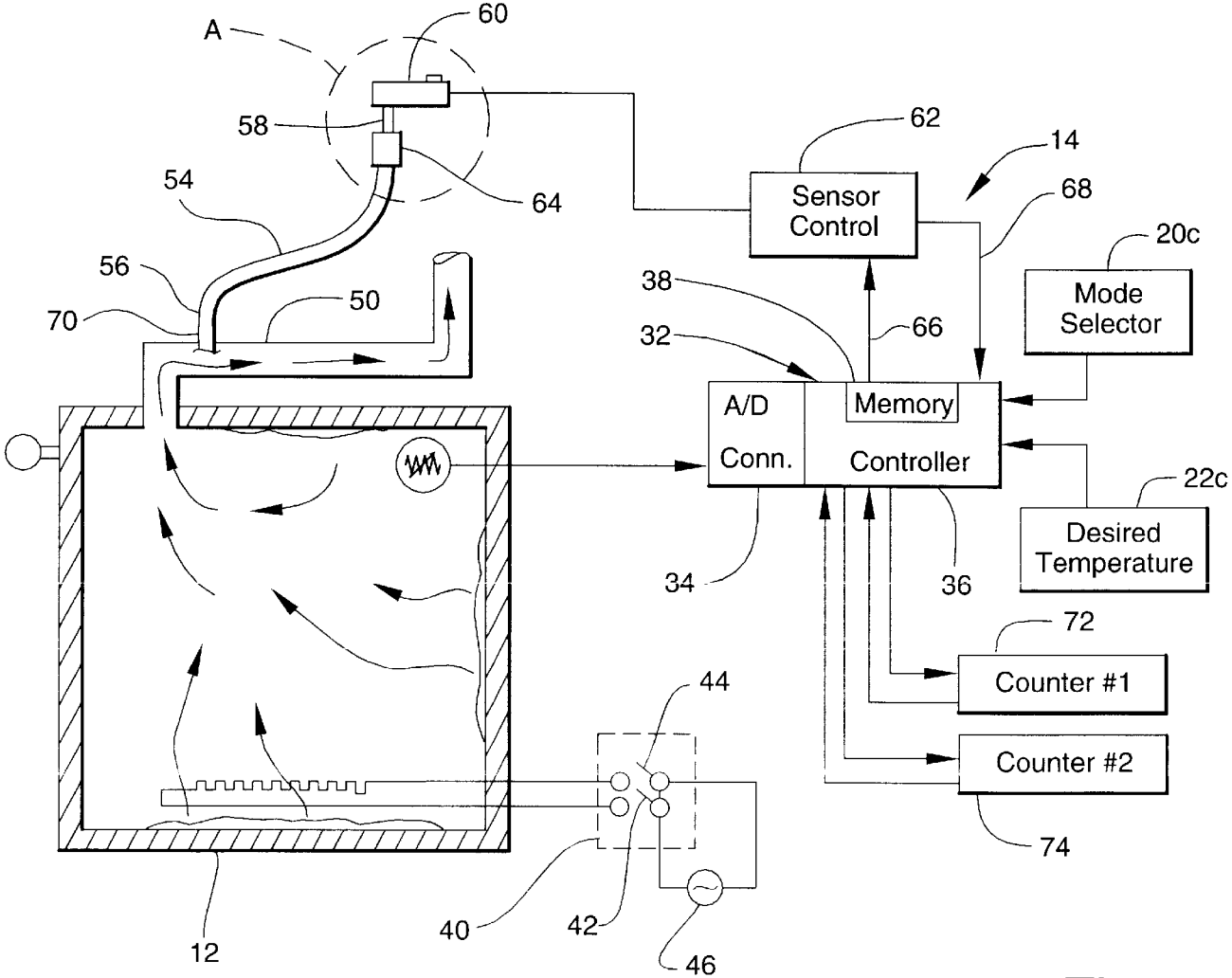
FIG. 2 is a schematic side section of an oven incorporating the principles of the present invention.

FIGS. 1 and 2 illustrate an electric range 10 having a self-cleaning oven 12 adapted to be controlled by a microprocessor based control system 14 and a method in accordance with the principles of the present invention. Although an electric range 10 is illustrated, it should be understood that a gas range may implement the features of the present invention.

The range 10 includes a plurality of control knobs 16 for controlling a respective plurality of conventional electric (or gas) burners 18. In addition, the range 10 includes a control knob 20 for controlling a mode of operation of the oven 12. For example, an OFF mode, a bake mode, a broil mode and a clean mode of operation may be selected by the control knob 20 (as indicated at 20C in FIG. 2). In addition, a control knob 22 is conventionally provided to select a desired oven temperature within the oven 12 (as indicated at 22C in FIG. 2). A timer knob may optionally be provided in the event that the control permits a user override to individually control the length of time for a cleaning process. Disposed within a cavity 24 of the oven 12 are a conventional broiling element 26 and a conventional heating element 28. Furthermore, positioned within the cavity 24 of the oven 12 is a conventional temperature sensor 30, such as, for example, a standard oven temperature sensing probe.

The microprocessor based control system 14 includes a microprocessor 32 suitably programmed to effect the desired control of the range 10. Conventionally, the microprocessor 32 includes an analog-to-digital (a/d) converter 34 for receiving analog voltage input signals from, for example, the temperature sensor 30, and for providing digital output pulses or signals to a controller section 36 within the microprocessor 32. Also, conventionally, the microprocessor 32 includes a memory 38 for retaining programmed instructions for operating the control system 14 including a desired oven temperature control algorithm for controlling the temperature of the oven 12, particularly during the clean mode of operation.

The control system 14 also includes a power switching relay 40 having a pair of relay contacts 42 and 44 for switching power to a heating element, for example, the baking element 28, from a constant voltage (e.g. 240 volts) source 46 of alternating current electric power under the control of the controller 36. For simplification, only the baking element 28 and the power relay 40 therefore have been illustrated in FIG. 2 in the control system 14. In an actual commercial embodiment, however, the broiling element 26 could, of course, be a part of the control system 14 along with its own power switching relay to interconnect the broiling element 26 to the source 46. The broiling element 26 is used in conjunction with a heating element 28 during the broil mode of operation of the oven 12 and may further be used during the bake and clean modes of the oven 12 to provide sufficient heat to the oven 12 under the control of the controller 36.

Figure 3:
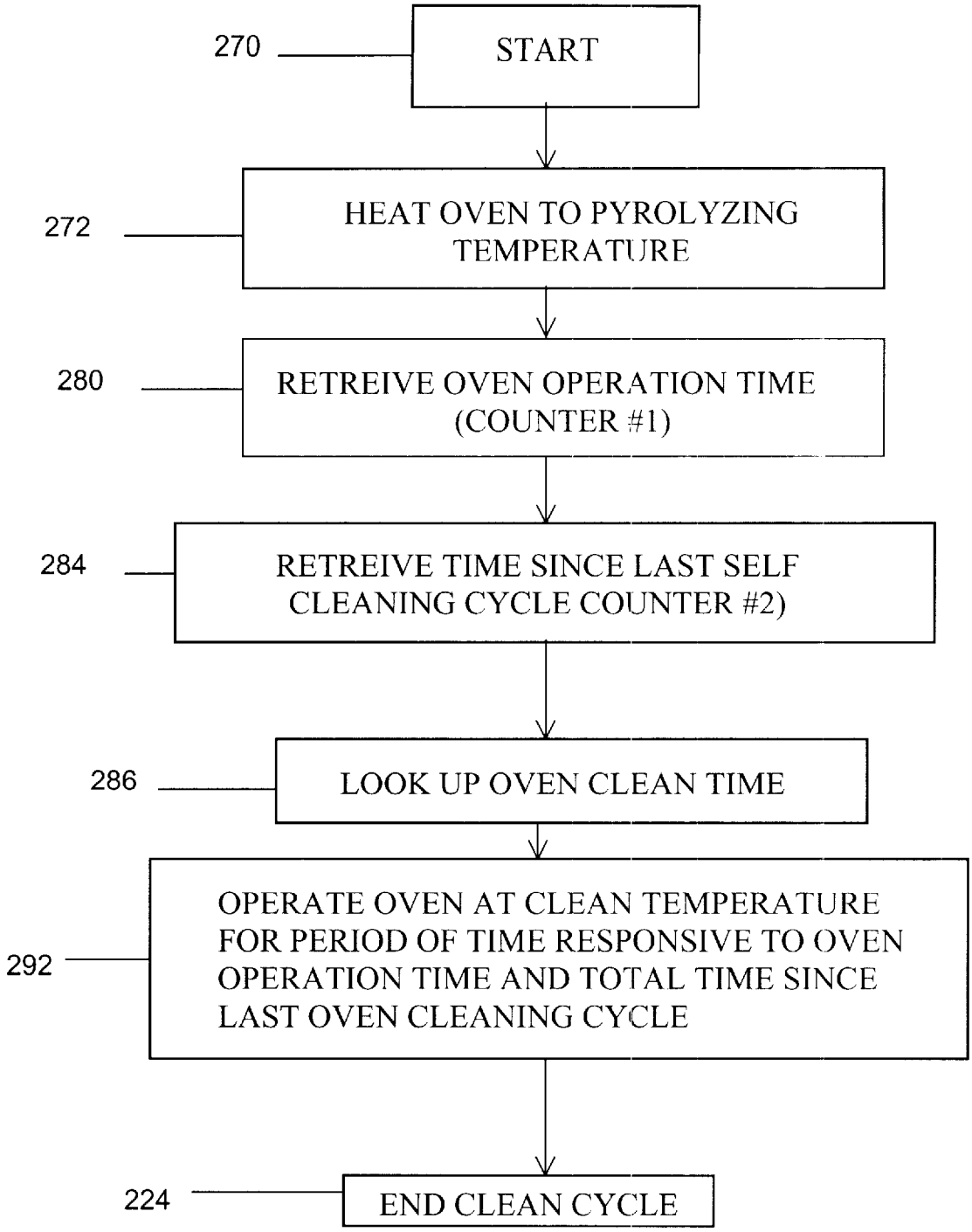
FIG. 3 is a flow chart describing a cleaning time control operation for the clean cycle in accordance with the principles of the present invention.

FIG. 3 illustrates a method according to the present invention that may be used to control the time for a self-cleaning cycle. In the present invention, a first counter 72 (FIG. 2) counts or measures the hours of oven use since the last self clean operation—the actual run times for the broil and bake operations since the last self clean operation. The counter 72 may be associated with the control 36 for measuring the time the oven has been operated since the previous self clean cycle or the counter 72 may be associated with the control selection knobs 20, 22 to count the number of times and/or duration of the bake or broil modes since the previous self cleaning cycle. A second counter or timer 74 is used to determine the length of time, in days or weeks, since the last cleaning cycle.

Once a self clean cycle operation has been started or selected, shown at step 270, the oven is heated to a pyrolyzing temperature, shown in step 272. Pyrolyzing temperatures are typically greater than 750° F. At or around the start of oven heating, control passes to step 280 where the total oven operation time or hours of oven use since the last self cleaning cycle is retrieved from the first counter 72. The total oven operation time since the last self cleaning cycle may be expressed in minutes or hours. In step 284, the total time since the last clean cycle is retrieved from the second counter 74. The total time since the last self cleaning cycle may be expressed in days or weeks. The control 36 then references a lookup table, as shown in step 286, to determine the oven clean time which corresponds to the measured oven operation duration and total time since the last oven cleaning. In step 292 a timer is initiated to operate the cleaning cycle for the selected oven clean time and, once the selected time has passed, control passes to step 224 to end the cycle. At the end of such self cleaning cycle, the oven operation duration counter 72 and the total time since last cleaning cycle counter 74 would be reset to zero.

Figure 4:
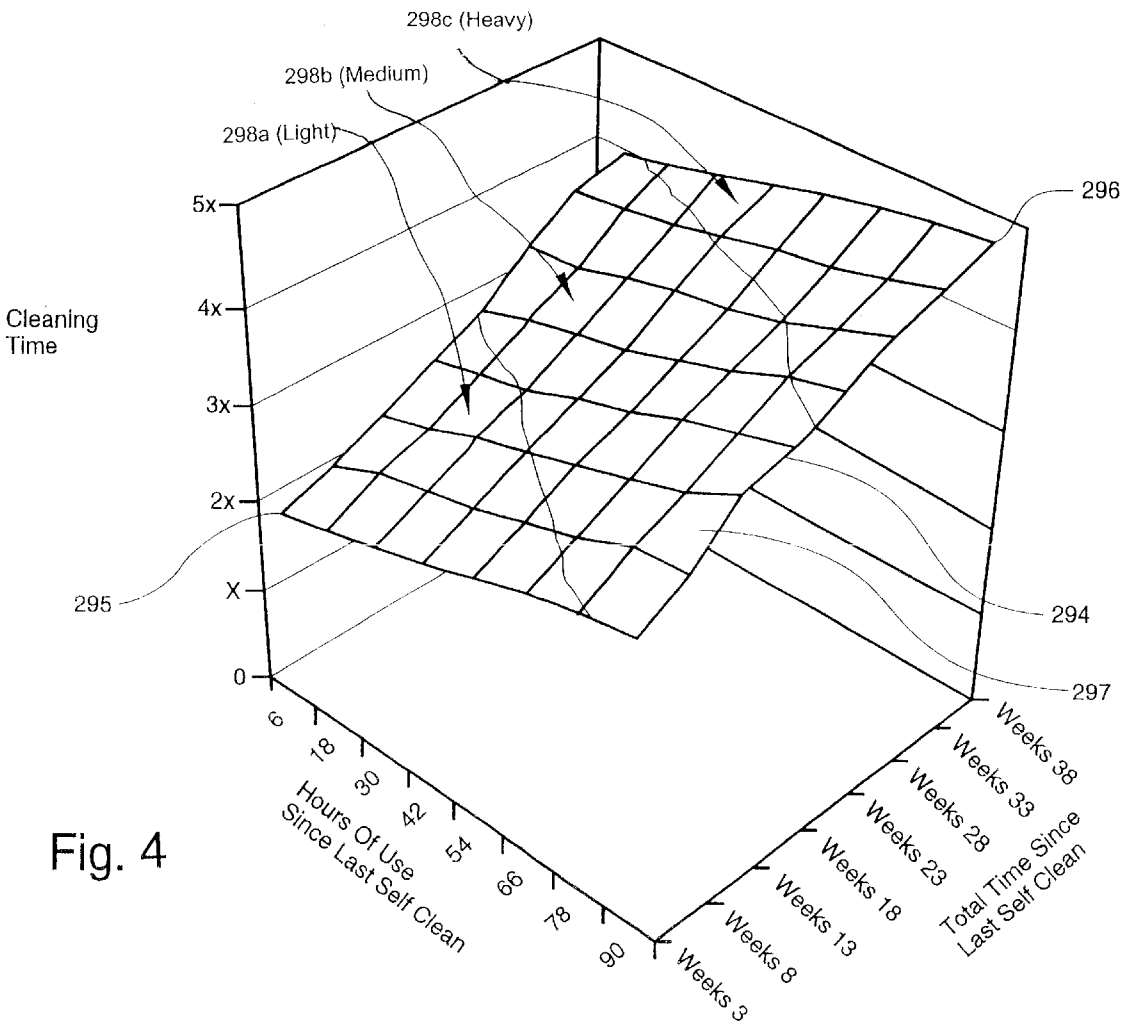
FIG. 4 is a graphic illustration of bake and broil cycles vs. weeks since last self-clean cycle vs. time for self-clean cycle.

FIG. 4 graphically illustrates values that could be placed into a look up table which is checked in step 286 as described above. This graph extends in three dimensions and along two perpendicular horizontal axes lists the hours of total use since the last cleaning cycle and the number of weeks representing a period of time since the last cleaning cycle has occurred. The vertical axis represents a period of time for the self-clean cycle which are values that would be experimentally determined for each particular type of oven cavity. Shown suspended in the graph is a surface 294 that extends horizontally but also is angled vertically starting from a low point at the leftmost corner 295, representing the lowest number of hours of use and fewest number of weeks since the last cleaning and a high point at the rightmost corner 296 representing the highest number of hours of use and greatest number of weeks since the last cleaning. This surface 294 can be divided into grid pieces 297 for particular numerical values being the average of the position of each grid piece, or it can be divided into large segments, such as the three illustrated—298*a* (LIGHT), 298*b* (MEDIUM) and 298*c* (HEAVY)—, representing a quantity of time x or a multiple of that quantity. Thus, the control can either provide finally divided time differences for the cleaning cycle based upon the value of each grid piece 297 or could provide fewer different cycle times (LIGHT, MEDIUM or HEAVY) based upon the larger segments 299. These values could be stored in a look-up table for the control to check in step 290.

As an alternative embodiment to counting or measuring the actual hours of oven use, the counter 72 comprise two counters for counting the number of bake cycles (BA cycles) and for counting the number of broil cycles (BR cycles) which have occurred since the last clean cycle. The required oven cleaning time could be determined from these two counts—the BA and BR cycles. The total time since the last self clean cycle—as measured by counter 74—could also be used with the BA and BR cycle counts to determine the most appropriate time period for a self clean cycle.

Another alternative method to implement the present invention could provided by counting the duration or time of the bake cycles (BA time) and counting the duration or time of the broil cycles (BR time) which has occurred since the last clean cycle. The required oven cleaning time could be determined from these two counts—the BA and BR times. The total time since the last self clean cycle—as measured by counter 74—could also be used with the BA and BR time counts to determine the most appropriate time period for a self clean cycle.

As is apparent from the foregoing specification, the invention is susceptible of being embodied with various alterations and modifications which may differ particularly from those that have been described in the preceding specification and description. It should be understood that we wish to embody within the scope of the patent warranted hereon all such modifications as reasonably and properly come within the scope of our contribution to the art.

The embodiments of the invention in which an exclusive property or privilege is claimed are defined as follows:

1. A method for controlling a self-cleaning oven having a cooking chamber, a heating device for supplying heat into the cooking chamber, an exhaust outlet from the cooking chamber leading to atmosphere, and a heat control device for controlling the heating device for baking, broiling and self-cleaning cycles, comprising:

maintaining a count of the length of oven operation time performed since a last self-cleaning cycle;

accepting an input at the heat control device to begin a self-cleaning operation; and controlling the heating device to heat the oven cavity to a pyrolyzing temperature for a time period based upon the amount of oven operation time performed since a last self-cleaning cycle.

2. A method for controlling a self-cleaning oven according to claim 1, further comprising the step of:

maintaining a count of the length of time since a last self-cleaning cycle; and wherein the controlling step further includes controlling the heating device to a pyrolyzing temperature to heat the oven cavity for a time period based upon the amount of time since a last self-cleaning cycle in addition to the amount of oven operation time performed since a last self-cleaning cycle.

3. A method for controlling a self-cleaning oven according to claim 1, further comprising the step of:

referring to a look up table to determine the time required for the time period, the look-up table relating oven operation time since a last self-cleaning cycle to the optimal oven cleaning duration.

4. A method for controlling a self-cleaning oven according to claim 2, further comprising the step of:

referring to a look up table to determine the time required for the time period, the look-up table relating oven operation time since a last self-cleaning cycle and the total time since a last self-cleaning operation to the optimal oven cleaning duration.

5. A method for controlling a self-cleaning oven according to claim 1, further comprising the step of:

displaying a count down of the time period at which the oven cavity is heated to a pyrolyzing temperature.

6. A method for controlling a self-cleaning oven having a cooking chamber, a heating device for supplying heat into the cooking chamber, an exhaust outlet from the cooking chamber leading to atmosphere, and a heat control device for controlling the heating device for baking, broiling and self-cleaning cycles, comprising:

maintaining a count of the length of oven operation time performed since a last self-cleaning cycle;

accepting an input to begin a self-cleaning operation; and heating the interior of the oven cavity to a pyrolyzing temperature; and maintaining the oven cavity at a pyrolyzing temperature for a period of time based upon the amount of oven operation time performed since a last self-cleaning cycle.

7. A method for controlling a self-cleaning oven according to claim 6, further comprising the step of:

maintaining a count of the length of time since a last self-cleaning cycle; and wherein the step of maintaining the oven temperature at a pyrolyzing temperature further includes maintaining the oven temperature at a pyrolyzing temperature for a time period based upon the amount of oven operation time performed since a last self-cleaning cycle in addition to the amount of time since a last self-cleaning cycle.

8. A method for controlling a self-cleaning oven according to claim 6, further comprising the step of:

referring to a look up table to determine the time required for the time period, the look-up table relating oven operation time since a last self-cleaning cycle to the optimal oven cleaning duration.

9. A method for controlling a self-cleaning oven according to claim 7, further comprising the step of:

referring to a look up table to determine the time required for the time period, the look-up table relating oven operation time since a last self-cleaning cycle and the total time since a last self-cleaning operation to the optimal oven cleaning duration.

10. A method for controlling a self-cleaning oven according to claim 6, further comprising the step of:

displaying a count down of the time period at which the oven cavity is heated to a pyrolyzing temperature.

11. A method for controlling a self-cleaning oven according to claim 8 wherein the look-up table relates oven operation time since a last self-cleaning cycle to one of three different cleaning times corresponding to a LIGHT, MEDIUM or HEAVY cleaning period.

12. A method for controlling a self-cleaning oven according to claim 9 wherein the look-up table relates oven operation time since a last self-cleaning cycle and the total time since a last self-cleaning operation to one of three different cleaning times corresponding to LIGHT, MEDIUM or HEAVY.

13. A method for controlling a self-cleaning oven having a cooking chamber, a heating device for supplying heat into the cooking chamber, an exhaust outlet from the cooking chamber leading to atmosphere, and a heat control device for controlling the heating device for baking, broiling and self-cleaning cycles, comprising:

maintaining a count of the number of bake cycles performed since a last self-cleaning cycle;

maintaining a count of the number of broil cycles performed since a last self-cleaning cycle;

accepting an input at the heat control device to begin a self-cleaning operation; and heating the interior of the oven cavity to a pyrolyzing temperature; and maintaining the oven cavity at a pyrolyzing temperature for a period of time based upon the number of bake and broil cycles performed since a last self-cleaning cycle.

14. A method for controlling a self-cleaning oven according to claim 13, further comprising the step of:

referring to a look up table to determine the time required for the time period, the look-up table relating the number of bake and broil cycles since a last self-cleaning cycle to the optimal oven cleaning duration.

15. A method for controlling a self-cleaning oven according to claim 14 wherein the look-up table relates the number of bake and broil since a last self-cleaning cycle to one of three different cleaning times corresponding to a LIGHT, MEDIUM or HEAVY cleaning period.

* * * * *